US009947461B2

(12) United States Patent
Misaki et al.

(10) Patent No.: US 9,947,461 B2
(45) Date of Patent: Apr. 17, 2018

(54) REACTOR

(71) Applicants: AutoNetworks Technologies, Ltd., Yokkaichi (JP); Sumitomo Wiring Systems, Ltd, Suzuka (JP); Sumitomo Electric Industries, Ltd., Osaka (JP)

(72) Inventors: Takashi Misaki, Mie (JP); Shinichirou Yamamoto, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 15/306,894

(22) PCT Filed: Apr. 17, 2015

(86) PCT No.: PCT/JP2015/061896
§ 371 (c)(1),
(2) Date: Oct. 26, 2016

(87) PCT Pub. No.: WO2015/170570
PCT Pub. Date: Nov. 12, 2015

(65) Prior Publication Data

US 2017/0053733 A1 Feb. 23, 2017

(30) Foreign Application Priority Data

May 7, 2014 (JP) ..... 2014-096412

(51) Int. Cl.
*H01F 27/24* (2006.01)
*H01F 17/04* (2006.01)
(Continued)

(52) U.S. Cl.
CPC ..... *H01F 27/32* (2013.01); *H01F 27/02* (2013.01); *H01F 27/08* (2013.01); *H01F 27/255* (2013.01);
(Continued)

(58) Field of Classification Search
CPC ..... H01F 27/32; H01F 27/306; H01F 27/263; H01F 27/02
See application file for complete search history.

(56) References Cited

U.S. PATENT DOCUMENTS 8,416,046 B2 4/2013 Yoshikawa et al.
2009/0108971 A1* 4/2009 Okamoto ..... H01F 27/266 336/65
(Continued)

FOREIGN PATENT DOCUMENTS

JP 2004257206 A 9/2004
JP 2008028313 A 2/2008
(Continued)

*Primary Examiner* — Ronald Hinson
(74) *Attorney, Agent, or Firm* — Dinsmore & Shohl LLP

(57) ABSTRACT

Provided is a reactor having high joining strength between an end surface connecting member and an outer resin-molded portion and excellent reliability. A reactor includes a coil having a winding portion, a magnetic core having an inner core portion disposed inside the winding portion and an outer core portion disposed outside the winding portion, an end surface connecting member that is fixed to an end portion of the inner core portion and disposed between an end surface of the winding portion and the outer core portion, and an outer resin-molded portion that integrates the outer core portion and the end surface connecting member, wherein a detachment preventing portion is formed in the end surface connecting member, the detachment preventing portion being embedded in the outer resin-molded portion
(Continued)

and having a detachment preventing shape that suppresses detachment of the outer resin-molded portion.

11 Claims, 8 Drawing Sheets

(51) Int. Cl.

| | |
|---|---|
| ***H01F 27/02*** | (2006.01) |
| ***H01F 27/30*** | (2006.01) |
| ***H01F 27/32*** | (2006.01) |
| ***H01F 37/00*** | (2006.01) |
| ***H01F 27/08*** | (2006.01) |
| ***H01F 27/255*** | (2006.01) |
| ***H01F 27/26*** | (2006.01) |
| ***H01F 27/28*** | (2006.01) |

(52) U.S. Cl.
CPC ..... *H01F 27/263* (2013.01); *H01F 27/28* (2013.01); *H01F 27/306* (2013.01); *H01F 37/00* (2013.01)

(56) References Cited

U.S. PATENT DOCUMENTS

| | | | | |
|---|---|---|---|---|
| 2011/0156853 | A1* | 6/2011 | Kato | H01F 27/306 336/192 |
| 2013/0038415 | A1* | 2/2013 | Ooishi | H01F 27/22 336/61 |
| 2013/0088317 | A1* | 4/2013 | Tawara | H01F 17/06 336/212 |
| 2014/0292456 | A1* | 10/2014 | Suzuki | H01F 27/402 336/55 |
| 2015/0130576 | A1* | 5/2015 | Suzuki | H01F 27/00 336/92 |

FOREIGN PATENT DOCUMENTS

| | | | |
|---|---|---|---|
| JP | 2010206104 | A | 9/2010 |
| JP | 2011199238 | A | 10/2011 |
| JP | 2012154341 | A | 8/2012 |
| JP | 2013084767 | A | 5/2013 |
| JP | 2013135191 | A | 7/2013 |
| WO | 2014045868 | A1 | 3/2014 |

* cited by examiner

REACTOR

CROSS-REFERENCE TO RELATED APPLICATIONS

This application is the U.S. national stage of PCT/JP2015/061896 filed Apr. 17, 2015, which claims priority of Japanese Patent Application No. JP 2014-096412 filed May 7, 2014.

FIELD OF THE INVENTION

The present invention relates to a reactor used for a constituent component or the like of an in-vehicle DC-DC converter or a power conversion device installed in an electric vehicle such as a hybrid automobile.

BACKGROUND

Magnetic components, such as reactors and motors, that are provided with a coil that has a winding portion formed by winding a wire and a magnetic core that is partially disposed inside the winding portion are used in various fields. As such magnetic components, for example JP 2013-135191A, JP 2013-84767A and JP 2011-199238A disclose reactors used for a circuit component of a converter installed in an electric vehicle such as a hybrid automobile.

As an example of conventional reactors, a configuration including a coil, a magnetic core, and end surface connecting members has been proposed (see FIG. 6 (frame-shaped bobbin 62) etc. of JP 2013-135191A or FIG. 3 (side bobbins 44a, 44b) etc. of JP 2013-84767A). Generally, a coil having a pair of winding portions and a ring-shaped magnetic core having a pair of inner core portions disposed inside the respective winding portions and a pair of outer core portions disposed outside the winding portions are used as the coil and the magnetic core. Usually, the inner core portions are joined to the outer core portions using an adhesive (see paragraphs 0050, 0072, etc. of JP 2011-199238A). Moreover, the end surface connecting members are disposed at end portions of the inner core portions and are each disposed between an end surface of the winding portions and a corresponding one of the outer core portions. The end surface connecting members are provided to thereby position the inner core portions and the outer core portions and ensure insulation of the winding portions from the outer core portions. In JP 2013-84767A (see paragraph 0046), the outer core portions are disposed on the respective end surface connecting members (side bobbins) by bonding, fitting, or the like.

SUMMARY OF INVENTION

For example, according to the conventional reactor disclosed in JP 2013-84767A mentioned above, it has been proposed to manufacture a reactor by forming a ring-shaped magnetic core by bonding or fitting the outer core portions to the end surface connecting members. However, since surfaces of the end surface connecting members that are joined to the outer core portions are flat surfaces, bonding may result in insufficient joining strength, and, at worst, there is a risk that the outer core portions may detach from the end surface connecting members. In the case of fitting as well, there is a risk that the joining strength may be insufficient as in the case of bonding. Thus, when the end surface connecting members are fixed to the end portions of the respective inner core portions, the outer core portions are assembled to the respective end surface connecting members, and the inner core portions and the outer core portions are thus positioned and fixed by means of the end surface connecting members, there is a risk that insufficient joining strength between each outer core portion and the corresponding end surface connecting member may result in insufficient connection of the inner core portions to the outer core portions. Therefore, a configuration is desirable that can securely integrate the outer core portions and the end surface connecting members and that thus can make the connection of the outer core portions to the inner core portions more secure.

The present invention was made in view of the above-described circumstances, and it is an object thereof to provide a reactor that enables outer core portions and end surface connecting members to be securely integrated and that thus can make the connection of the outer core portions to the inner core portions more secure.

SUMMARY OF INVENTION

A reactor according to an aspect of the present invention is a reactor including a coil having a winding portion, a magnetic core having an inner core portion disposed inside the winding portion and an outer core portion disposed outside the winding portion, an end surface connecting member that is fixed to an end portion of the inner core portion and disposed between an end surface of the winding portion and the outer core portion, and an outer resin-molded portion that integrates the outer core portion and the end surface connecting member, wherein a detachment preventing portion is formed in the end surface connecting member, the detachment preventing portion being embedded in the outer resin-molded portion and having a detachment preventing shape that suppresses detachment of the outer resin-molded portion.

The above-described reactor enables the outer core portion and the end surface connecting member to be securely integrated and thus can make the connection between the outer core portion and the inner core portion to be more secure.

DETAILED DESCRIPTION OF THE PREFERRED EMBODIMENTS

Figure 1:
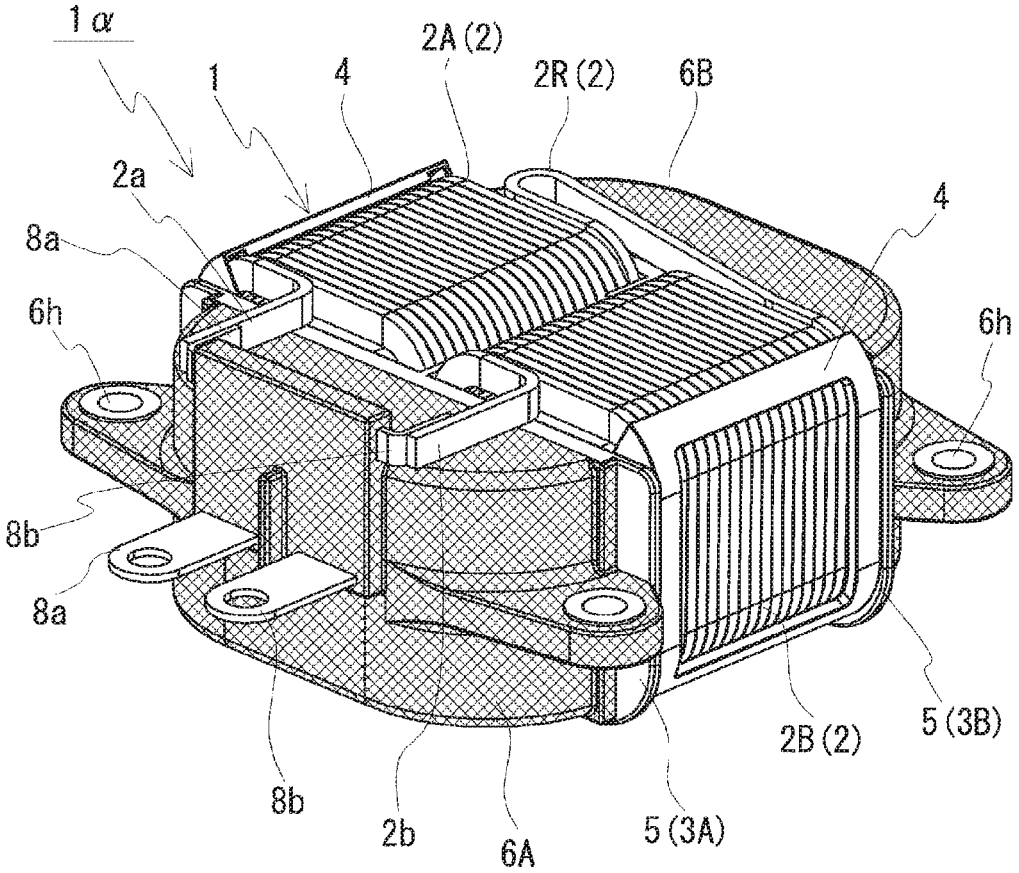
FIG. 1 shows a schematic perspective view of a reactor of Embodiment 1.

First, aspects of the present invention will be listed and described.

(1) A reactor according to an aspect of the present invention includes a coil having a winding portion, and a magnetic core having an inner core portion disposed inside the winding portion and an outer core portion disposed outside the winding portion. Also, the reactor includes an end surface connecting member that is fixed to an end portion of the inner core portion and disposed between an end surface of the winding portion and the outer core portion, and an outer resin-molded portion that integrates the outer core portion and the end surface connecting member. Moreover, a detachment preventing portion is formed in the end surface connecting member, the detachment preventing portion being embedded in the outer resin-molded portion and having a detachment preventing shape that suppresses detachment of the outer resin-molded portion.

With the above-described reactor, the outer core portion and the end surface connecting member are integrated by the outer resin-molded portion, and furthermore, the detachment preventing portion that is embedded in the outer resin-molded portion is formed in the end surface connecting member fixed to the end portion of the inner core portion. Since the detachment preventing shape of the detachment preventing portion prevents detachment of the outer resin-molded portion, detachment of the outer resin-molded portion from the end surface connecting member can be suppressed, and the joining strength between the end surface connecting member and the outer resin-molded portion can be increased. Therefore, the outer core portion and the end surface connecting member can be securely integrated via the outer resin-molded portion, and thus, the connection between the outer core portion and the inner core portion can be made more secure. Moreover, the above-described reactor has excellent productivity in that it is possible to securely join the outer core portion and the end surface connecting member to each other and securely connect the outer core portion and the inner core portion to each other without using an adhesive. It should be noted that in the present invention, the use of an adhesive is not completely denied, and an adhesive may be supplementally used in manufacturing of the reactor.

(2) As an example of the above-described reactor, according to another aspect, the detachment preventing shape of the detachment preventing portion may be a shape having a bent portion.

As a result of the detachment preventing portion having the bent portion, the bent portion serves as a barb when embedded in the outer resin-molded portion, and is hooked on the outer resin-molded portion, and thus detachment of the outer resin-molded portion can be effectively suppressed. Therefore, the joining strength between the end surface connecting member and the outer resin-molded portion can be increased, and the outer core portion and the end surface connecting member are securely integrated, so that the outer core portion and the inner core portion are more securely connected to each other.

(3) As an example of the above-described reactor, according to another aspect, the coil may have a pair of winding portions that are arranged side-by-side, and the magnetic core may be a ring-shaped core having a pair of inner core portions disposed inside the respective winding portions and a pair of outer core portions connected to opposite ends of the inner core portions, and a plurality of said end surface connecting members are provided, each being disposed between a respective end surface of the pair of winding portions and one of the outer core portions. Moreover, according to this aspect, a core component may be provided in which one of the end surface connecting members is integrally molded with the end portion of a corresponding one of the inner core portions by resin molding.

Since the end surface connecting member is integrally molded with the end portion of the inner core portion, the outer core portion can be connected to the inner core portion by integrating the outer core portion with the end surface connecting member of the core component. Since the end surface connecting member is integrally molded with the end portion of the inner core portion, the necessity to separately prepare the end surface connecting member is eliminated, and the number of components can be reduced. In addition, the necessity for an operation of fixing the end surface connecting member to the end portion of the inner core portion with an adhesive or the like is also eliminated. Moreover, it is also possible to form a ring-shaped magnetic core using a pair of said core components having the same shape. In this case, the pair of core components are identical components having the same shape and therefore can be produced using a single forming mold, so that the cost can be reduced.

(4) As an example of the above-described reactor, according to another aspect, the reactor may include a coil cover that is attached to an outer circumferential surface of the winding portion, and an engagement protrusion for engaging with the end surface connecting member may be formed in the coil cover.

The coil cover is attached to the winding portion, and also the coil cover is engaged with the end surface connecting member via the engagement protrusion. In this manner, an assembly into which the coil, the inner core portion, and the end surface connecting member are integrated using the coil cover can be easily produced simply by engagement. Accordingly, the productivity of the reactor can be improved. Furthermore, the outer core portion can be connected to the inner core portion by integrating the outer core portion with the end surface connecting member of the assembly, and the reactor can thus be manufactured. In some cases, the assembly can be produced without using an adhesive. In particular, since no adhesive is used in the whole production process of the reactor, the necessity for storage and management of an adhesive is eliminated, and the necessity for a hardening step of hardening an adhesive is also eliminated. It should be noted that the use of an adhesive is not completely denied, and an adhesive may be supplementally used in production of the assembly.

(5) As an example of the above-described reactor, according to another aspect, an engagement hole into which the engagement protrusion is fitted may be formed in the end surface connecting member.

Fitting the engagement protrusion of the coil cover into the engagement hole of the end surface connecting member allows the coil cover to be accurately positioned relative to the end surface connecting member, and consequently, the winding portion to which the coil cover is attached is also positioned relative to the end surface connecting member. Furthermore, since the end surface connecting member is fixed in the state in which the end surface connecting member is positioned at the end portion of the inner core portion, the position of the inner core portion relative to the winding portion is also fixed by the engagement between the end surface connecting member and the coil cover.

(6) As an example of the above-described reactor, according to another aspect, the engagement protrusion may be inserted into the engagement hole from the coil cover, a leading end side of the engagement protrusion may protrude from an opposite side of the end surface connecting member and may be embedded in the outer resin-molded portion, and the engagement protrusion may have a detachment preventing shape on the leading end side, the detachment preventing shape suppressing detachment of the outer resin-molded portion.

The leading end side of the engagement protrusion of the coil cover passes through the engagement hole and protrudes from the opposite side of the end surface connecting member, and is thus embedded in the outer resin-molded portion. Also, the engagement protrusion has the detachment preventing shape on the leading end side thereof. The detachment preventing shape on the leading end side of the engagement protrusion allows the coil cover to be securely joined to the outer resin-molded portion, and thus, detachment of the coil cover from the end surface connecting member can be suppressed via the outer resin-molded portion. Moreover, detachment of the outer resin-molded portion from the end surface connecting member can also be suppressed.

Hereinafter, specific examples of a reactor according to an embodiment of the present invention will be described with reference to the drawings. In the drawings, like reference numerals denote objects having like names. It should be noted that the present invention is not limited to these examples, but rather is intended to be defined by the appended claims, and all changes that come within the meaning and range of equivalency of the claims are intended to be embraced therein.

Embodiment 1

Overall Configuration of Reactor

Figure 2:
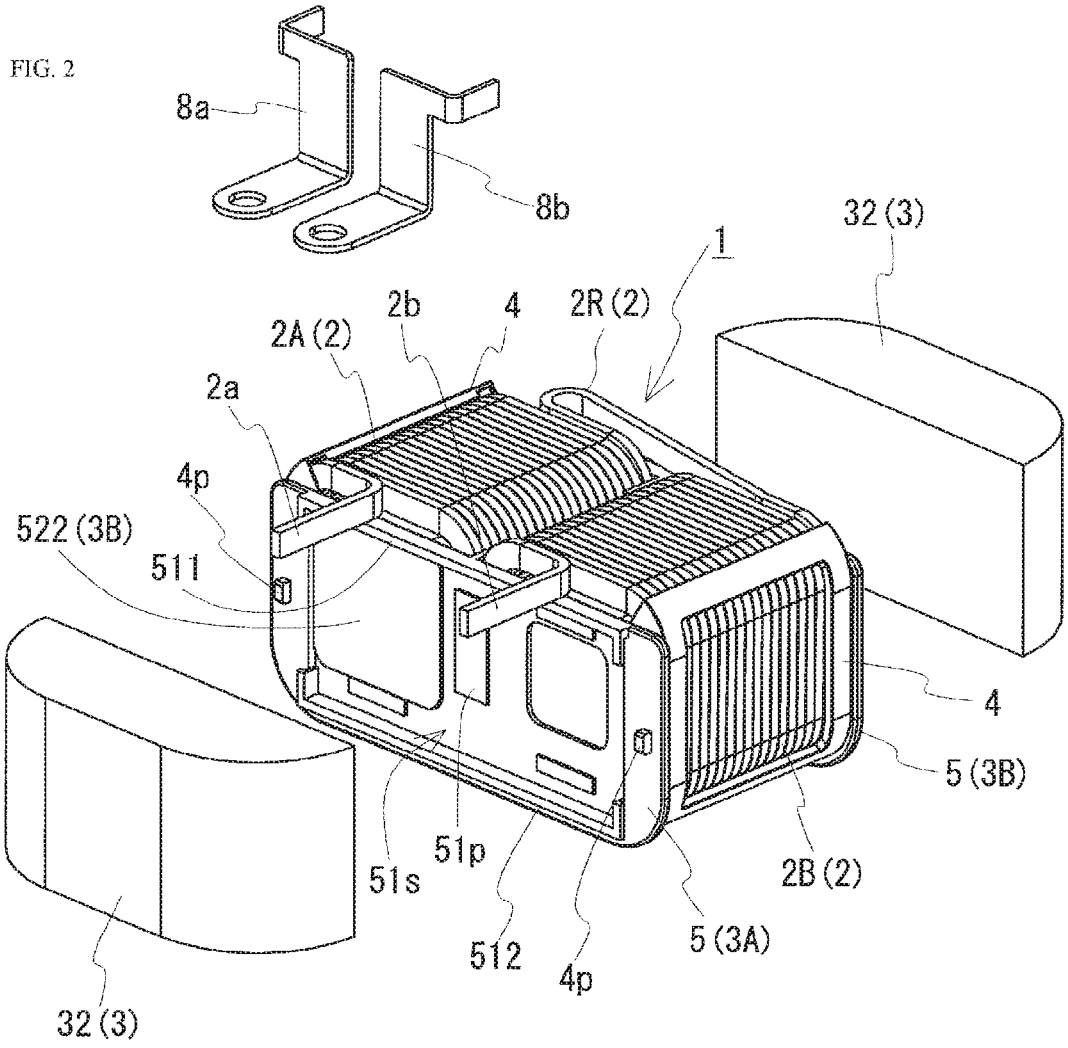
FIG. 2 shows a schematic perspective view of an assembly and outer core products provided in the reactor of Embodiment 1.
Figure 3:
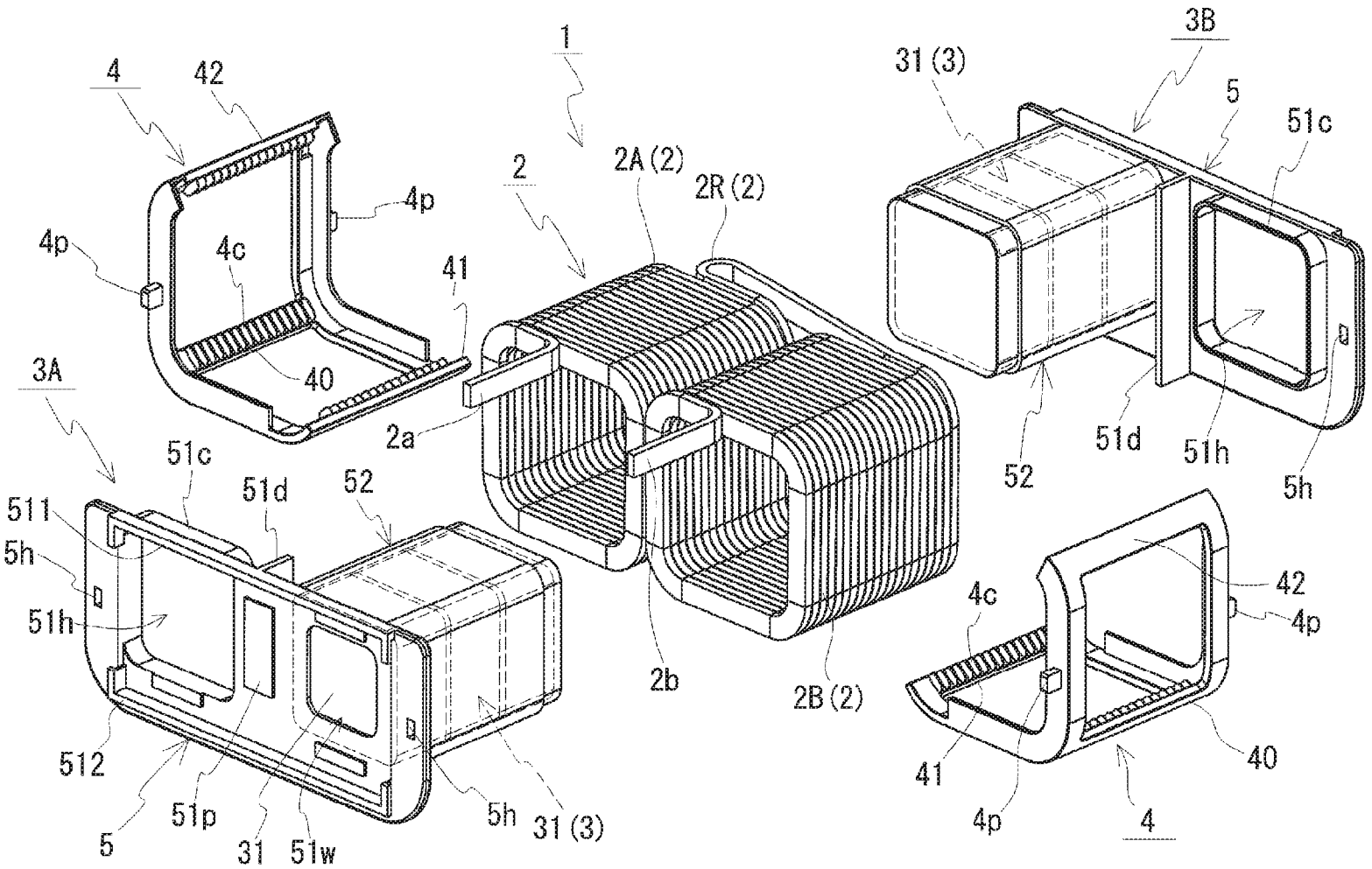
FIG. 3 shows a schematic exploded perspective view of the assembly provided in the reactor of Embodiment 1.
Figure 4:
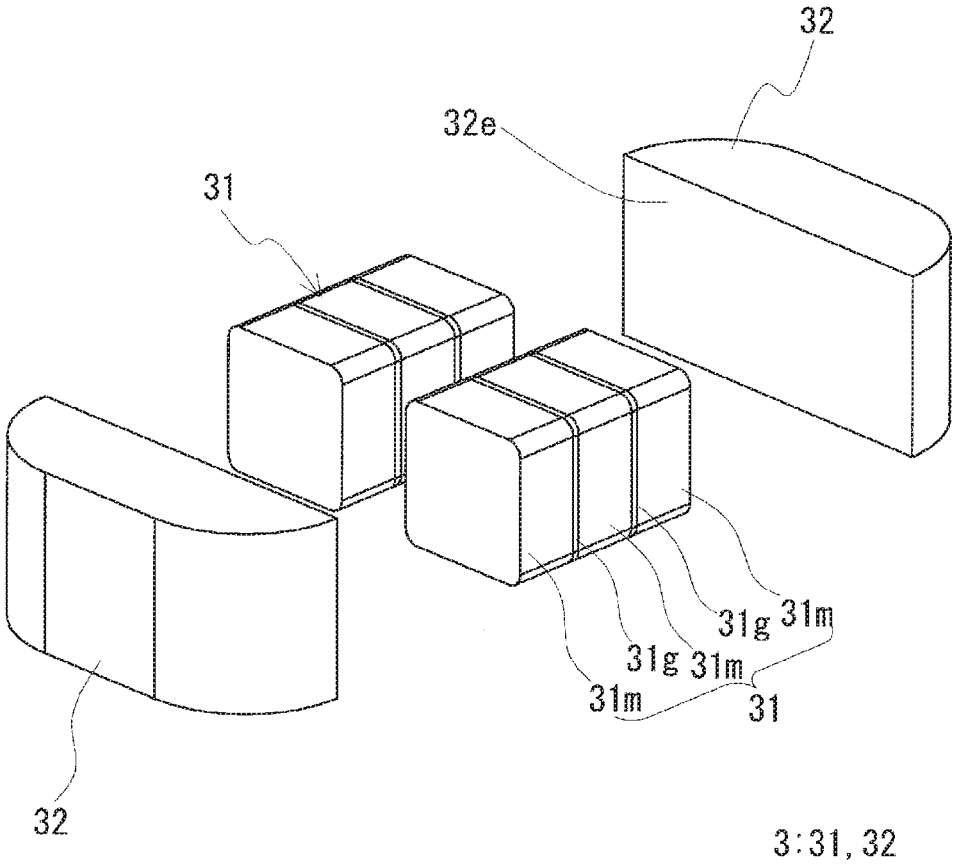
FIG. 4 shows a schematic exploded perspective view of a magnetic core provided in the reactor of Embodiment 1.
Figure 5:
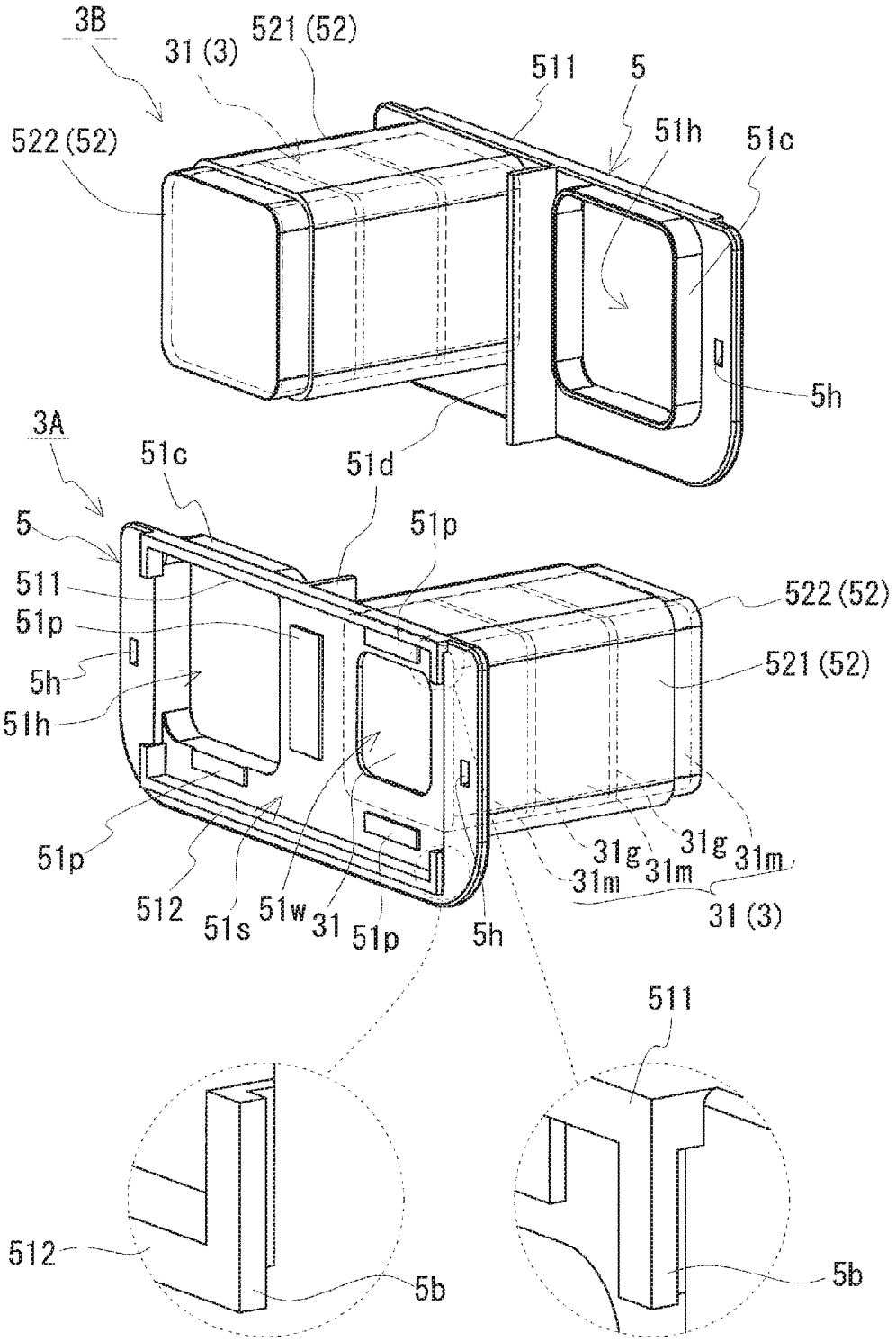
FIG. 5 shows a schematic perspective view of core components, which are constituent members of the assembly provided in the reactor of Embodiment 1.
Figure 6:
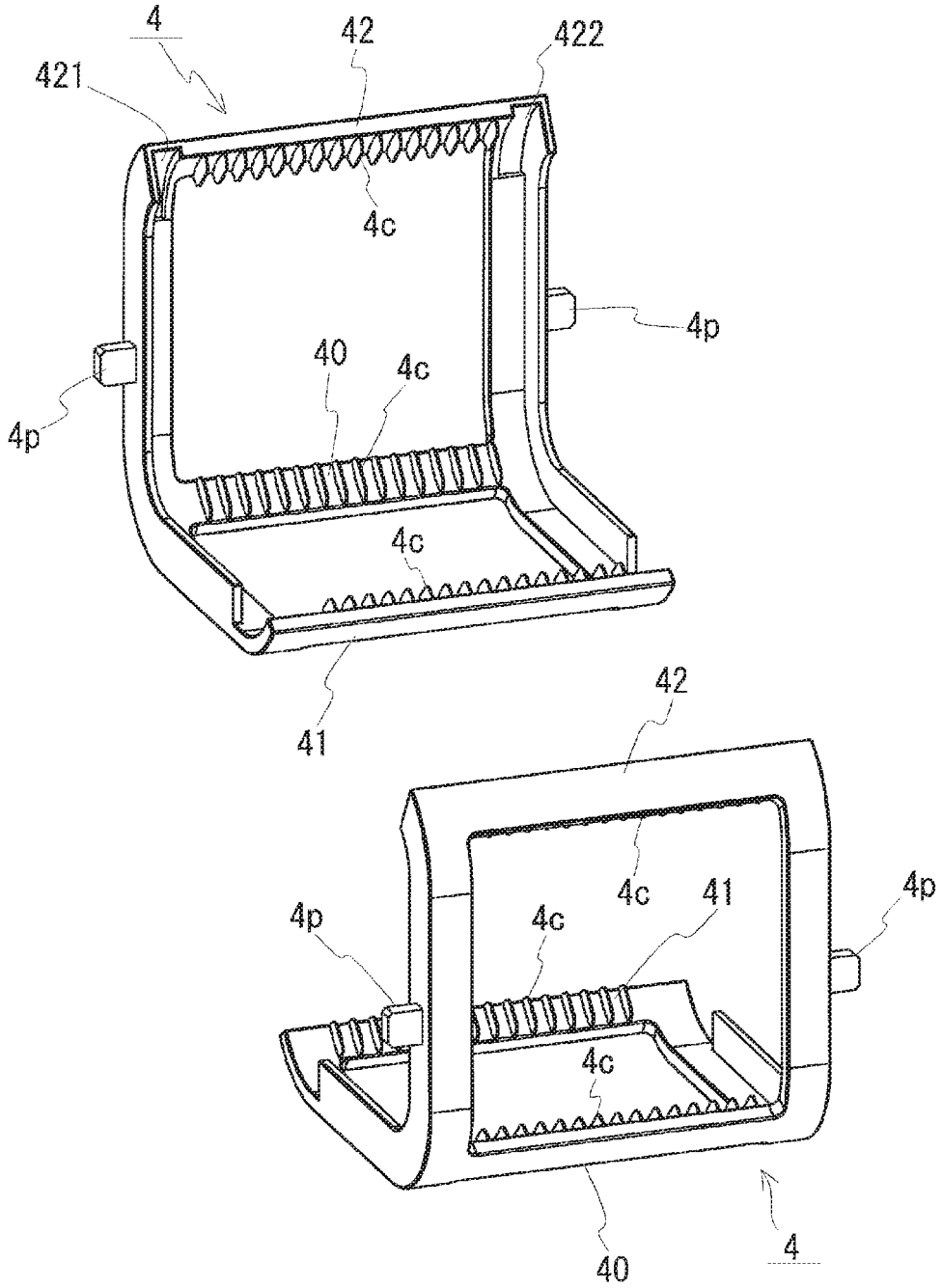
FIG. 6 shows a schematic perspective view of coil covers, which are constituent members of the assembly provided in the reactor of Embodiment 1.

A reactor 1α of Embodiment 1 will be described with reference to FIGS. 1 to 6. FIG. 1 shows a schematic perspective view of the reactor 1α, FIG. 2 shows a schematic perspective view of an assembly 1 and outer core portions 32 provided in the reactor 1α, FIG. 3 shows a schematic exploded perspective view of the assembly 1, and FIG. 4 shows a schematic exploded perspective view of a magnetic core 3 provided in the reactor 1α. Also, FIG. 5 shows a schematic perspective view of core components 3A and 3B, which are constituent members of the assembly 1, and FIG. 6 shows a schematic perspective view of coil covers 4, which are also constituent members of the assembly 1. It should be noted that in FIG. 1, outer resin-molded portions 6A and 6B, which are constituent members of the reactor 1α, are indicated by cross-hatching.

The reactor 1α of Embodiment 1 shown in FIG. 1 includes, like conventional reactors, a coil 2 and the magnetic core 3 (see FIG. 4) that forms a ring-shaped closed magnetic circuit. The reactor 1α is used in a state in which its surface on a lower side (lower side of the paper plane in FIG. 1) is in contact with an installation target such as a cooling base. The coil 2 has a pair of winding portions 2A and 2B that are each formed by winding a wire (see also FIG. 3). The magnetic core 3 is formed in a ring shape, having a pair of inner core portions 31 (see FIGS. 3 and 4) that are disposed inside the respective winding portions 2A and 2B as well as a pair of outer core portions 32 (see FIGS. 2 and 4) that are disposed outside the two winding portions 2A and 2B and connected to opposite ends of the inner core portions 31. Furthermore, the reactor 1α of Embodiment 1 includes a pair of end surface connecting members 5 that are disposed on opposite end portions of the two inner core portions 31 and are each disposed between a corresponding one end surface of the pair of winding portions 2A and 2B and a corresponding one of the outer core portions 32. The reactor 1α also includes the outer resin-molded portions 6A and 6B that integrate the respective outer core portions 32 with the corresponding end surface connecting members 5. A main difference from conventional reactors is that the end surface connecting members 5 have detachment preventing portions for suppressing detachment of the outer resin-molded portions 6A and 6B, the detachment preventing portions being located at positions that are embedded in the outer resin-molded portions 6A and 6B. Hereinafter, the configuration of the reactor 1α will be described in detail.

Coil

As shown in FIG. 3, the coil 2 has the pair of winding portions 2A and 2B and a connecting portion 2R that connects the two winding portions 2A and 2B to each other. The winding portions 2A and 2B are formed into hollow tube shapes by winding the wires with the same number of turns in the same winding direction and are arranged side-by-side such that the axial directions of the two elements are parallel to each other. Moreover, the connecting portion 2R is a portion that connects the two winding portions 2A and 2B to each other on one end side of the two winding portions 2A and 2B and that is bent into a U-shape. The coil 2 may be formed by winding a single continuous wire, or may be formed by forming the winding portions 2A and 2B using separate wires and joining wire end portions of the respective winding portions 2A and 2B to each other by welding, crimping, or the like.

Each winding portion 2A, 2B is formed into a quadrangular tube shape, and end surfaces thereof with respect to an axial direction have a quadrangular shape (rectangular shape or square shape) with rounded corners. It goes without saying that the winding portions 2A and 2B are not limited to quadrangular tube shapes, and can also be formed in other polygonal tube shapes or a cylindrical tube shape. A cylindrical tube-shaped winding portion refers to a winding portion whose end surfaces have a closed curve shape (perfect circle shape, elliptical shape, racetrack shape, or the like).

The coil 2 including the winding portions 2A and 2B is formed of a covered wire including a conductor, such as a rectangular wire, a round wire or the like, made of a conductive material, such as copper, aluminum, magnesium, or an alloy thereof, and an insulating covering made of an insulating material and provided on an outer circumference of the conductor. In this example, each winding portion 2A, 2B is formed by winding a covered rectangular wire edgewise, the covered rectangular wire being constituted by a rectangular wire made of copper, which serves as the conductor, and the insulating covering made of enamel (typically, polyamideimide).

Both end portions 2*a* and 2*b* of the coil 2 are drawn out from the other end side of the winding portions 2A and 2B, and terminal members 8*a* and 8*b* (see FIG. 2) are respectively attached to these end portions 2*a* and 2*b*. An external device (not shown) such as a power supply that supplies power to the coil 2 is connected via the terminal members 8*a* and 8*b*. The direction in which the end portions 2*a* and 2*b* are drawn out is not limited, but in this example, the end portions 2*a* and 2*b* are drawn out in the axial direction of the winding portions 2A and 2B.

Inner Core Portions

The inner core portions 31 are members that are disposed inside the respective winding portions 2A and 2B (see FIG. 3) of the coil 2. As shown in FIG. 4, each inner core portion 31 is a stacked column-shaped body in which core pieces 31*m* containing a magnetic material and having a substantially rectangular parallelepiped shape and gap materials 31*g* having a lower magnetic permeability than the core pieces 31*m* are alternately stacked on each other. Alternatively, each inner core portion 31 may be formed of a single core piece having a column shape. Each inner core portion 31 may be entirely accommodated in the corresponding winding portion 2A, 2B, or at least a portion thereof at one end or at the other end in the axial direction may protrude from the corresponding winding portion 2A, 2B. A powder compact obtained by pressure molding a soft magnetic powder typically composed of an iron-group metal, such as iron, or an alloy thereof, a composite material obtained by molding a mixture containing a soft magnetic powder and a resin, a stacked body obtained by stacking a plurality of magnetic thin plates (e.g., electromagnetic steel sheets) having an insulating coating, and the like can be used for the core pieces 31*m*. Moreover, a non-magnetic material such as alumina can be used for the gap materials 31*g*. Alternatively, the gap materials 31*g* can also be formed from a resin that forms core covering portions 52 (see FIG. 5), which will be described later.

Outer Core Portions

As shown in FIG. 4, the outer core portions 32 are members that are connected to opposite ends of the inner core portions 31 and that form the ring-shaped magnetic core 3 together with the inner core portions 31. The outer core portions 32 are disposed outside the winding portions 2A and 2B (see FIG. 3) and protrude from the winding portions 2A and 2B without being covered by the winding portions 2A and 2B. The shape of the outer core portions 32 is not limited, and the outer core portions 32 can have any shape that has an inner end surface 32*e* connectable to end surfaces of the pair of inner core portions 31. In this example, the outer core portions 32 are each a column-shaped body whose upper and lower surfaces are substantially dome-shaped. Alternatively, the outer core portions 32 may have a substantially rectangular parallelepiped shape.

As in the case of the core pieces 31*m* of the inner core portions 31, the outer core portions 32 can be formed of a powder compact obtained by pressure molding a soft magnetic powder, can be formed of a composite material obtained by molding a mixture containing a soft magnetic powder and a resin, or can be formed of a stacked body obtained by stacking a plurality of electromagnetic steel sheets. The outer core portions 32 may be formed from the same material as the core pieces 31*m* of the inner core portions 31, or may be formed from a different material. In the latter case, for example, a configuration is conceivable in which the core pieces 31*m* of the inner core portions 31 are formed of a powder compact, and the outer core portions 32 are formed of a composite material.

End Surface Connecting Members

As shown in FIGS. 2 and 3, the end surface connecting members 5 are members that are respectively disposed on end portions of the two inner core portions 31 and that position the inner core portions 31 and the outer core portions 32. Moreover, each end surface connecting member 5, when disposed between an end surface of the winding portions 2A and 2B of the coil 2 and a corresponding one of the outer core portions 32, also has the function of ensuring insulation therebetween. In this example, the end surface connecting members 5 are individually fixed to one end portion of the respective inner core portions 31. The end surface connecting members 5 have detachment preventing portions (positioning portions 511 and 512, which will be described later, double as these detachment preventing portions) that suppress detachment of the outer resin-molded portions 6A and 6B (see FIG. 1), the detachment preventing portions being formed on an outer surface of each end surface connecting member 5 that is located on the side where the corresponding outer core portion 32 is disposed.

Core Components

In the present embodiment, as shown in FIG. 5, one of the end surface connecting members 5 is integrally molded with the end portion of one of the inner core portions 31 by resin molding, and a pair of core components 3A and 3B are formed in this manner. Specifically, a circumferential surface of the inner core portion 31 is covered with a resin by resin molding to form the core covering portion 52, and also the end surface connecting member 5 is formed at the end portion of the inner core portion 31 using a portion of this resin. The two core components 3A and 3B are the components having the same shape as shown in FIG. 5, and the core component 3A looks the same as the core component 3B when rotated 180° in a horizontal direction. The two core components 3A and 3B are not necessarily required to have the same shape.

The core covering portion 52 is formed on a circumferential surface of the inner core portion 31 so as to extend over the entire length of the inner core portion 31 in a longitudinal direction thereof, and when disposed between an inner circumferential surface of the winding portion 2A or 2B (see FIG. 3) and the inner core portion 31, the core covering portion 52 also has the function of ensuring insulation therebetween. That is to say, the core covering portion 52 plays a role corresponding to an inner connecting member (inner bobbin) of a conventional reactor. This core covering portion 52 has a large diameter portion 521 extending a predetermined length from the end surface connecting member 5 and a small diameter portion 522 that is continuous with the large diameter portion 521. The outer diameter of the small diameter portion 522 is smaller than the outer diameter of the large diameter portion 521, and the inner diameter of the small diameter portion 522 is equal to the inner diameter of the large diameter portion 521. That is to say, the small diameter portion 522 is formed to have a smaller wall thickness than the large diameter portion 521.

In this example, using resin molding, the core covering portion 52 is formed on the inner core portion 31, and also the end surface connecting member 5 is integrally molded with the inner core portion 31. In this manner, the end surface connecting member 5 is fixed to the end portion of the inner core portion 31. It goes without saying that each core component 3A, 3B can also be formed by separately preparing the inner core portion 31 having the core covering portion 52 and the end surface connecting member 5 and fixing the end surface connecting member 5 to the end portion of the inner core portion 31 by bonding, fitting, or the like.

Furthermore, in this example, during formation of the core covering portion 52 by resin molding, the core pieces 31*m* are arranged at intervals in a mold, and the gap materials 31*g* are formed by filling the resin into air gaps between the core pieces 31*m*. Thus, an inner core portion 31 is obtained in which the plurality of core pieces 31*m* are integrated together, and also the gap materials 31*g* formed of the resin that forms the core covering portion 52 are formed between the core pieces 31*m*.

The end surface connecting member 5 and the core covering portion 52 can be formed by insert molding. With regard to the material composing the end surface connecting member 5 and the core covering portion 52, for example, thermoplastic resins such as polyphenylene sulfide (PPS) resins, polytetrafluoroethylene (PTFE) resins, liquid crystal polymers (LCPs), polyamide (PA) resins such as nylon 6 and nylon 66, polybutylene terephthalate (PBT) resins, and acrylonitrile-butadiene-styrene (ABS) resins can be used. In addition, thermoplastic resins such as unsaturated polyester resins, epoxy resins, urethane resins, and silicone resins can also be used. Moreover, it is also possible to increase heat conductivity and improve heat dissipation properties by mixing a ceramics filler in these resins. For example, a non-magnetic powder composed of alumina, silica, or the like can be used as the ceramics filler.

On the outer surface of the end surface connecting member 5 that is located on the side where the outer core portion 32 is disposed, the positioning portions 511 and 512 that define the position at which the outer core portion 32 is attached to the end surface connecting member 5 are formed (see FIGS. 2 and 5). The positioning portions 511 and 512, which are protrusions protruding from the outer surface of the end surface connecting member 5, are provided on upper and lower portions, respectively, of the end surface connecting member 5 and are formed in square bracket shapes, enclosing an outer edge of an end portion of the outer core portion 32 that is located on the inner end surface side. The space enclosed by these square bracket-shaped positioning portions 511 and 512 constitutes an accommodation space 51*s* in which a portion of the end portion of the outer core portion 32 is accommodated, so that the outer core portion 32 is positioned relative to the end surface connecting member 5. In this example, a portion enclosed by the positioning portions 511 and 512 is slightly recessed from the other portions (portions which extend in opposite outward lateral directions and in which engagement holes 5*h*, which will be described later, are formed).

Here, the positioning portions 511 and 512 also have the function of detachment preventing portions that suppress detachment of the outer resin-molded portions 6A and 6B (see FIG. 1), which will be described later. That is to say, the positioning portions 511 and 512 double as the detachment preventing portions. Specifically, as shown in the insets circled by dotted lines in FIG. 5, the positioning portion 511 has a substantially L-shaped cross section on both lateral sides, and the positioning portion 512 has a substantially L-shaped cross section on both lateral sides and a lower side. That is to say, detachment preventing shapes are formed by protruding end portions of the positioning portions 511 and 512 having bent portions 5*b* that are bent in an outward direction (direction opposite to the accommodation space 51*s*) substantially into an L-shape. The bent portions 5*b* (detachment preventing shapes) of the positioning portions (detachment preventing portions) 511 and 512 are embedded in the outer resin-molded portions 6A and 6B.

In this example, the detachment preventing shapes are formed in portions of the positioning portions 511 and 512 so that the positioning portions 511 and 512 also serve as the detachment preventing portions. However, a protrusion (detachment preventing portion) having a detachment preventing shape may also be formed separately from those positioning portions as long as this protrusion is formed at a position that is not located in the accommodation space 51*s* of the end surface connecting member 5 and that is embedded in the outer resin-molded portion 6A or 6B. A detachment preventing portion can be formed at any position that is located on the outer surface of the end surface connecting member 5 and that is embedded in the outer resin-molded portion 6A or 6B. Moreover, although the detachment preventing shapes described above are the shapes having substantially L-shaped bent portions 5*b*, the present invention is not limited to this, and any shape that suppresses detachment of the outer resin-molded portion 6A or 6B in a state in which it is embedded in the outer resin-molded portion 6A or 6B can be adopted. For example, various shapes such as a shape that becomes wider toward a leading end side, a shape whose circumferential surface has irregularities or a notch, and the like as well as a shape that has a bent portion that is substantially U-shaped or the like can be adopted as the detachment preventing shapes of the detachment preventing portions.

On a bottom surface (surface that opposes the inner end surface of the corresponding outer core portion 32) of the accommodation space 51*s* of the end surface connecting member 5, a plurality of protruding portions 51*p* protruding from that bottom surface are formed (see FIGS. 2 and 5). These protruding portions 51*p* are the portions for supporting the outer core portion 32 that is fitted in the accommodation space 51*s* at a distance from the bottom surface of the accommodation space 51*s*. With the inner end surface of the outer core portion 32 being supported at a distance from the bottom surface of the accommodation space 51*s*, the resin can spread even into a gap that is formed between the inner end surface of the outer core portion 32 and the bottom surface of the accommodation space 51*s* when the outer core portion 32 and the end surface connecting member 5 are integrated by the outer resin-molded portion 6A or 6B, which will be described later. Therefore, gaps that are formed between the outer core portion 32 and the individual inner core portions 31 can be filled with the resin. In this manner, the resin enters into the gaps between the outer core portion 32 and the individual inner core portions 31, allowing almost no air gap to be formed, so that variations of the magnetic characteristics (inductive etc.) caused by an air gap can be reduced, and stable magnetic characteristics can be obtained. Moreover, since a gap that is formed between the end surface connecting member 5 and the corresponding outer core portion 32 is filled with the resin, and thus hardly any air gap is formed therebetween, the joining strength between the end surface connecting member 5 and the outer core portion 32 can be improved. The outer core portion 32 and the end surface connecting member 5 are securely integrated with each other by the outer resin-molded portion 6A or 6B, and therefore the effect of suppressing backlash between the outer core portion 32 and the end surface connecting member 5 that is caused by vibrations transmitted from the vehicle as well as vibrations that are caused by an air gap can be expected.

In this example, the protruding portions 51*p* are arranged at a plurality of locations in a distributed manner, and thus a flow path for the resin is formed in gaps between the protruding portions 51*p*, so that the resin easily spreads into the gap that is formed between the inner end surface of the outer core portion 32 and the bottom surface of the accommodation space 51*s*. The distributed arrangement of the protruding portions 51*p* enables adjustment of the flow of the resin, and thus the resin can be filled uniformly. The protruding height of these protruding portions 51*p* from the bottom surface can be selected as appropriate so that a gap of a predetermined length is formed between the outer core portion 32 and the individual inner core portions 31. Moreover, the positions at which the protruding portions 51*p* are disposed can be selected as appropriate in accordance with the viscosity and the like of the resin so that the resin can smoothly flow in the gaps between the outer core portion 32 and the individual inner core portions 31 (end surface connecting member 5). As in this example, a smooth flow of the resin can be produced by forming a flow path for the resin by arranging the protruding portions 51*p* in the accommodation space 51*s* in a distributed manner, and changing the flow path formation state by adjusting the number of protruding portions 51*p* and the arrangement of the protruding portions 51*p*.

As shown in FIG. 5, in each end surface connecting member 5, a window 51*w* is formed in a portion of the bottom surface of the accommodation space 51*s* that corresponds to the end surface of the inner core portion 31, and the end surface of the inner core portion 31 is exposed from this window 51*w*. Thus, when the outer core portion 32 and the end surface connecting member 5 are integrated by the outer resin-molded portion 6A or 6B, the resin flows into the window 51*w*, so that a resin gap is formed between the inner core portion 31 and the outer core portion 32.

Moreover, in the end surface connecting member 5 of one core component 3A (3B), an insertion hole 51*h* is formed in a portion of the bottom surface of the accommodation space 51*s* that corresponds to the end surface of the inner core portion 31 of the other core component 3B (3A). A leading end portion of the small diameter portion 522 of the core covering portion 52 of the core component 3B (3A) is inserted into the insertion hole 51*h* of the end surface connecting member 5 of the core component 3A (3B) (see FIG. 2).

Furthermore, a tubular portion 51*c* and a partition portion 51*d* are formed on an inner surface of each end surface connecting member 5 that is located on the side where the inner core portion 31 is disposed (i.e., surface that is located on the opposite side to the side where the outer core portion 32 is disposed (see FIG. 5). The tubular portion 51*c* protrudes from the inner surface, and the cavity of the tubular portion 51*c* communicates with the above-described insertion hole 51*h*.

The partition portion 51*d* is provided at a position between the above-described tubular portion 51*c* and the inner core portion 31 having the core covering portion 52 so as to protrude from the inner surface of the end surface connecting member 5. When each core component 3A, 3B is assembled to the coil 2 (see FIG. 3), this partition portion 51*d* is disposed between the winding portions 2A and 2B and keeps the two winding portions 2A and 2B in a separated state. This separation makes it possible to reliably ensure insulation between the winding portions 2A and 2B.

In one core component 3A (3B), the external shape of the small diameter portion 522 of the core covering portion 52 of the inner core portion 31 is substantially the same as the internal shape of the above-described tubular portion 51*c*, so that the small diameter portion 522 can be inserted into the tubular portion 51*c* of the end surface connecting member 5 of the other core component 3B (3A). Therefore, when the core components 3A and 3B are brought close to each other, and the small diameter portion 522 of the core component 3A is fitted into the tubular portion 51*c* of the core component 3B and vice versa, the two core components 3A and 3B are connected to each other, forming a ring shape (see FIG. 2). At this time, a step that is formed between the large diameter portion 521 and the small diameter portion 522 of the core covering portion 52 of each inner core portion 31 abuts against an end surface of the mating tubular portion 51*c*, and thus the two core components 3A and 3B are positioned at predetermined relative positions.

In addition, in each of the end surface connecting members 5, the engagement holes 5*h* are formed into which engagement protrusions 4*p* of coil covers 4, which will be described below, are fitted (see FIGS. 2 and 3). The positions at which these engagement holes 5*h* are formed are located outward of the position at which the outer core portion 32 is disposed.

In this example, the engagement holes 5*h* are respectively provided in portions extending in the opposite outward lateral directions from a central portion enclosed by the positioning portions 511 and 512. Moreover, the engagement holes 5*h* are each formed to have an internal shape and internal dimensions that allow the corresponding engagement protrusion 4*p* of the coil covers 4 to be press-fitted into the engagement hole 5*h*. Specifically, the engagement holes 5*h* each have an internal shape and internal dimensions that are similar to and slightly smaller than the external shape of a base portion of the corresponding engagement protrusion 4*p*.

Outer Resin-Molded Portions

The outer resin-molded portions 6A and 6B (see FIG. 1) are members that integrate the outer core portions 32 with the respective end surface connecting members 5 (see FIG. 2). Specifically, in a state in which the outer core portions 32 are disposed on the respective end surface connecting members 5, a circumferential surface of each of the outer core portions 32 is covered with a resin, and thus, the outer resin-molded portions 6A and 6B are formed. Moreover, during formation of the outer resin-molded portions 6A and 6B, the bent portions 5*b* (detachment preventing shapes) provided in the positioning portions (detachment preventing portions) 511 and 512 of the end surface connecting members 5 are embedded in the outer resin-molded portions 6A and 6B. Thus, the outer core portions 32 can be integrated with the respective end surface connecting members 5 by the outer resin-molded portions 6A and 6B, and detachment of the outer resin-molded portions 6A and 6B from the respective end surface connecting members 5 can be suppressed by the detachment preventing shapes. Accordingly, the joining strength between each end surface connecting member 5 and the corresponding outer resin-molded portion 6A, 6B can be increased, so that the outer core portions 32 can be securely integrated with the respective end surface connecting members 5, and the connection of the outer core portions 32 to the inner core portions 31 can be made more secure. Since the outer core portions 32 are securely connected to the inner core portions 31, backlash between each outer core portion 32 and the inner core portions 31 that is caused by vibrations transmitted from the vehicle can be suppressed. In this example, the outer resin-molded portions 6A and 6B are formed in such a manner that leading ends of the engagement protrusions 4*p* of the coil covers 4 that protrude from the end surface connecting members 5 are also embedded in the outer resin-molded portions 6A and 6B. The outer resin-molded portions 6A and 6B formed on the two outer core portions 32 are formed separately and are not integrated with each other.

More specifically, the outer resin-molded portions 6A and 6B are each formed so as to cover the entire circumferential surface of the corresponding outer core portion 32 and the outer surface (surface on the side where the outer core portion 32 is disposed of the corresponding end surface connecting member 5. Therefore, as shown in FIG. 1, the coil 2 (winding portions 2A and 2B) is not covered by the outer resin-molded portions 6A and 6B. Moreover, a portion of the resin of each of the outer resin-molded portions 6A and 6B enters into a gap that is formed between the inner end surface of the outer core portion 32 and the outer surface (bottom surface of the accommodation space 51*s*) of the end surface connecting member 5, and contributes to improvement in the joining strength between the outer core portion 32 and the end surface connecting member 5. It should be noted that the outer resin-molded portions 6A and 6B are not necessarily required to cover the entire circumferential surface of the respective outer core portions 32, and the outer core portions 32 may be partially exposed from the respective outer resin-molded portions 6A and 6B to the extent that a sufficient joining strength can be obtained between each outer core portion 32 and the corresponding end surface connecting member 5.

Furthermore, as shown in FIG. 1, the terminal members 8*a* and 8*b* as well as metal collars 6*h* are integrated with the outer resin-molded portions 6A and 6B. The collars 6*h* are provided with attachment holes for fixing the reactor 1α to the installation target.

The outer resin-molded portions 6A and 6B can be formed by insert molding. With regard to the material composing the outer resin-molded portions 6A and 6B, for example, thermoplastic resins such as PPS resins, PTFE resins, LCPs, PA resins (nylon 6, nylon 66, etc.), PBT resins, and ABS resins can be used. In addition, thermosetting resins such as unsaturated polyester resins, epoxy resins, urethane resins, and silicone resins can also be used. The unsaturated polyester resins have the advantages of being heat dissipation properties by mixing a ceramics filler such as alumina or silica in these resins.

Coil Covers

As shown in FIGS. 2, 3, and 6, the coil covers 4 are members that are attached to outer circumferential surfaces of the respective winding portions 2A and 2B. The main role of the coil covers 4 is to position the inner core portions 31 relative to the winding portions 2A and 2B by engaging with the end surface connecting members 5.

As shown in FIG. 6, each coil cover 4 is a member having a shape that is obtained by bending a plate material having two through-holes into an L-shape at a position between the two through-holes, or in other words, a shape that is obtained by connecting two frame-shaped members to each other into an L-shape. An open portion of the L-shape of the coil cover 4 functions as a fitting slit into which the winding portion 2A or 2B (see FIGS. 2 and 3) is fitted. Since the fitting slit is formed in each coil cover 4, the coil cover 4 can be attached by fitting the coil cover 4 to the winding portion 2A or 2B from the outer circumferential side of the winding portion 2A or 2B. Thus, it is easy to attach the coil covers 4 to the winding portions 2A and 2B.

An inner circumferential surface of a bent portion (see reference numeral 40) of the L-shape of each coil cover 4 has a shape corresponding to a corner portion of the quadrangular tube-shaped winding portion 2A or 2B (see FIG. 3). Moreover, those portions (see reference numerals 41 and 42) of each substantially L-shaped coil cover 4 that correspond to end portions of the L-shape are curved into shapes corresponding to respective corner portions of the winding portion 2A or 2B. The bent portion (retaining portion) 40 that is located at the bent portion of the L-shape and the curved portions (retaining portions) 41 and 42 that are located at the end portions of the L-shape retain, respectively, the corner portion connecting a lower surface and an outer surface of the winding portion 2A and 2B, the corner portion connecting the lower surface and an inner surface of that winding portion, and the corner portion connecting the outer surface and an upper surface of that winding portion among the four corner portions of the winding portion 2A or 2B with respect to the circumferential direction. These retaining portions 40, 41, and 42 stabilize the state in which the coil covers 4 are fixed to the winding portions 2A and 2B and make the coil covers 4 hard to detach from the winding portions 2A and 2B. It should be noted that in the case where the winding portions 2A and 2B are cylindrical tube-shaped, if the end surface shape of the coil covers 4 is set to a circular arc shape having a length that is longer than a half but not longer than three fourths of the circumferential length of the winding portions 2A and 2B, coil covers 4 that can be fitted to the winding portions 2A and 2B from the outer circumferential side thereof and that can be firmly attached to the winding portions 2A and 2B can be obtained.

A plurality of comb teeth 4*c* are formed on the inner circumferential surface of each of the curved portions 40, 41, and 42. The distance between adjacent comb teeth 4*c* is substantially equal to the thickness of each turn (wire) of the winding portions 2A and 2B. Thus, when the coil covers 4 are attached to the outer circumferential surfaces of the winding portions 2A and 2B, the comb teeth 4*c* are inserted between the turns of the winding portions 2A and 2B, and thus the individual turns are fitted between adjacent comb teeth 4*c*. The comb teeth 4*c* can suppress rubbing of the turns against each other and resulting damage to the insulation coating on the wire surface. Moreover, since the comb teeth 4*c* of the coil covers 4 are fitted between the turns of the winding portions 2A and 2B, the coil covers 4 are securely fixed to the winding portions 2A and 2B, and thus, detachment of the coil covers 4 due to vibrations transmitted from the vehicle can also be suppressed.

Turn accommodating portions 421 and 422 into which the first turn and the last turn of each winding portion 2A or 2B are fitted are respectively formed on one end side and the other end side of the retaining portion 42 of each coil cover 4 with respect to the axial direction (same as the axial direction of the winding portions 2A and 2B) of the coil cover 4. The length $L_1$ between the turn accommodating portions 421 and 422 is approximately equal to a length $L_2$ obtained by adding the total thickness of the turns that are disposed between the two accommodating portions 421 and 422 and the total thickness of the plurality of comb teeth 4*c* of the coil cover 4 (for example, $L_1=L_2\pm1$ mm or shorter). Forming the coil covers 4 having such a size can make the coil covers 4 hard to detach from the winding portions 2A and 2B.

Furthermore, the engagement protrusions 4*p* for mechanically engaging with the end surface connecting members 5 (see FIG. 3) are formed in each coil cover 4. The engagement protrusions 4*p* are the protrusions protruding in the axial direction of the coil cover 4, and are provided such that one each is disposed on one and the other end sides of the coil cover 4 with respect to the axial direction. Each engagement protrusion 4*p* is a substantially quadrangular prism-shaped protrusion and has a shape that is diagonally tapered toward its leading end side. Since the engagement protrusions 4*p* have a tapered shape, it is easy to fit the engagement protrusions 4*p* into the corresponding engagement holes 5*h* of the end surface connecting members 5.

Preferably, the coil covers 4 are formed from a non-conductive material. This makes it easy to ensure insulation between the installation target and the coil 2 when the reactor 1α is in contact with the installation target. Examples of the non-conductive material include thermoplastic resins such as PPS resins, PTFE resins, LCPs, PA resins (nylon 6, nylon 66, etc.), PBT resins, and ABS resins and thermosetting resins such as unsaturated polyester resins, epoxy resins, urethane resins, and silicone resins. Resins generally have good insulating properties and excellent flexibility. Thus, it is preferable to form the coil covers 4 from a resin, because this makes the coil covers 4 easy to fit into the winding portions 2A and 2B. It is also possible to improve heat dissipation properties by mixing a ceramics filler such as alumina or silica in the above-described resins.

Assembly

The assembly 1 shown in FIG. 2 is an assembly into which the coil 2, the core components 3A and 3B (integrated components obtained by integrating the inner core portions 31 with the respective end surface connecting members 5), and the coil covers 4 are combined and thus integrated. As described above with reference mainly to FIG. 5, each of the core components 3A and 3B is a component obtained by integrally molding one end surface connecting member 5 with the end portion of one inner core portion 31 by resin molding. Therefore, the assembly 1 can be said to be an assembly into which the coil 2 (winding portions 2A and 2B), the inner core portions 31, the end surface connecting members 5, and the coil covers 4 are integrated (see FIG. 3). Specifically, the assembly 1 is produced by attaching the coil covers 4 to the respective winding portions 2A and 2B by fitting the coil covers 4 to the outer circumferential surfaces of the respective winding portions 2A and 2B, and disposing the core components 3A and 3B such that the inner core portions 31 are inserted into the inside of the respective winding portions 2A and 2B, and also the engagement protrusions 4*p* of the coil covers 4 are inserted into the corresponding engagement holes 5*h* of the end surface connecting members 5. Thus, the assembly 1 can be easily produced simply by mechanical engagement of the coil covers 4 attached to the coil 2 with the end surface connecting members 5 fixed to the end portions of the inner core portions 31.

Other Configurations

In the reactor 1α shown in FIG. 1, a sensor unit may be disposed in a gap that is formed between the winding portions 2A and 2B. The sensor unit includes a sensor, a sensor holder for holding the sensor, and a cable for transmitting detection results of the sensor and that measures a physical quantity of the reactor during operation. The sensor may be, for example, a thermal element such as a thermistor, an acceleration sensor, or the like. Moreover, the sensor holder may be a member for not only holding the sensor but also fixing the sensor at a position between the winding portions 2A and 2B. If the sensor holder is provided with comb teeth that are disposed between the turns of the winding portions 2A and 2B, a state in which the sensor holder is fixed to the coil 2 can be stabilized.

Method for Manufacturing Reactor

A method for assembling the reactor 1α shown in FIG. 1 will be described with reference to FIGS. 1 to 3.

Production of Assembly

First, the assembly 1 shown in FIG. 2 is produced. For this purpose, as shown in FIG. 3, the coil 2, the coil covers 4, and the core components 3A and 3B are prepared. Then, the coil covers 4 are attached to the respective winding portions 2A and 2B of the coil 2 by fitting the coil covers 4 to the outer circumferential surfaces of the respective winding portions 2A and 2B. In this operation, the comb teeth 4*c* of the coil covers 4 are disposed between the turns of the winding portions 2A and 2B. At this time, the first turn and the last turn of each of the winding portions 2A and 2B are fitted into the turn accommodating portions 421 and 422 (see FIG. 6), respectively, of the corresponding coil cover 4, and the coil covers 4 are firmly fixed to the outer circumferential surfaces of the respective winding portions 2A and 2B.

Next, the inner core portions 31 of the core components 3A and 3B are inserted into the inside of the respective winding portions 2A and 2B. Then, the engagement protrusions 4*p* of the coil covers 4 are fitted into the corresponding engagement holes 5*h* of the end surface connecting members 5 of the core components 3A and 3B to bring the coil covers 4 into mechanical engagement with the end surface connecting members 5. At this time, the small diameter portion 522 on the core component 3A side is inserted into the insertion hole 51*h* on the core component 3B side, and the small diameter portion 522 on the core component 3B side is inserted into the insertion hole 51*h* on the core component 3A side. Thus, as shown in FIG. 2, the two core components 3A and 3B are connected to each other, forming a ring shape. The small diameter portions 522 inserted into the insertion holes 51*h* protrude from the bottom surfaces of the respective accommodation spaces 51*s* (see FIG. 2). The protruding length of the small diameter portions 522 is not longer than the protruding length of the protruding portions 51*p*.

In the above-described assembly 1, the positions of the coil covers 4 relative to the winding portions 2A and 2B are fixed, and the positions of the coil covers 4A, 4B relative to the end surface connecting members 5 are fixed. The end surface connecting members 5 are each integrated with the end portion of the corresponding inner core portion 31. Thus, the inner core portions 31 are accurately positioned relative to the winding portions 2A and 2B via the end surface connecting members 5 and the coil covers 4.

Integration of Outer Core Portions into Assembly

Next, as shown in FIG. 2, the outer core portions 32 are fitted into the accommodation spaces 51*s* of the respective end surface connecting members 5 of the assembly 1 (core components 3A and 3B), and furthermore, the terminal members 8*a* and 8*b* are connected to the respective end portions 2*a* and 2*b* of the coil 2 by soldering or the like. During fitting of the outer core portions 32, an adhesive may be applied to the inner end surface (surface opposing the outer surface of the end surface connecting member 5) of each outer core portion 32 in advance.

An integrated component into which the assembly 1, the outer core portions 32, and the terminal members 8*a* and 8*b* are integrated is placed in a mold, and also the metal collars 6*h* (see FIG. 1) are placed in the mold. Then, the resin is filled into the mold, and the resin is solidified (hardened) to form the outer resin-molded portions 6A and 6B. Thus, the outer core portions 32 and the end surface connecting members 5 are integrated. At this time, the outer resin-molded portions 6A and 6B are formed in such a manner that the bent portions 5*b* (see FIG. 5) provided in the positioning portions (detachment preventing portions) 511 and 512 of the end surface connecting members 5 are embedded in the resin, and thus, the reactor 1α shown in FIG. 1 is completed. The resin filling in the mold spreads thoroughly even into the gaps that are formed by the outer core portions 32 with the respective end surface connecting members 5. The reason for this is that since the protruding portions 51*p* are formed on the bottom surfaces of the accommodation spaces 51*s* of the end surface connecting members 5, the outer core portions 32 are separated from the respective bottom surfaces.

Here, as shown in the insets circled by dotted lines in FIG. 5, the bent portions 5*b* that are each bent in a protruding direction substantially into an L-shape are formed in the positioning portions 511 and 512, and these bent portions 5*b* function as detachment preventing portions. As a result of these substantially L-shaped bent portions 5*b* being embedded in the outer resin-molded portions 6A and 6B, the bent portions 5*b* serve as barbs, thereby suppressing detachment of the outer resin-molded portions 6A and 6B and improving the joining strength between each end surface connecting member 5 and the corresponding outer resin-molded portion 6A, 6B.

Effects

As described above, in the reactor 1α of Embodiment 1, the outer core portions 32 and the end surface connecting members 5 are integrated by the outer resin-molded portions 6A and 6B, and also the detachment preventing portions (positioning portions 511 and 512) having the detachment preventing shapes are formed in the end surface connecting members 5. Therefore, detachment of the outer resin-molded portions 6A and 6B from the end surface connecting members 5 can be suppressed, and the joining strength between each end surface connecting member 5 and the corresponding outer resin-molded portion 6A, 6B can be increased. Accordingly, the outer core portions 32 and the end surface connecting members 5 can be securely integrated by the outer resin-molded portions 6A and 6B, and thus, the connection of the outer core portions 32 to the inner core portions 31 can be made more secure. For example, in the above-described embodiment, the detachment preventing shapes are the shapes having the bent portions 5*b*, and these bent portions 5*b* serve as barbs, making it possible to effectively suppress detachment of the outer resin-molded portions 6A and 6B.

The reactor 1α of Embodiment 1 has excellent productivity. The reasons for this are as follows. Since the core components 3A and 3B, in each of which one of the end surface connecting members 5 is integrally molded with the end portion of a corresponding one of the inner core portions 31, are used, each inner core portion 31 and the corresponding end surface connecting member 5 can be handled as a single unit, and the necessity to separately perform the operation of joining the inner core portion 31 and the end surface connecting member 5 to each other is eliminated. Moreover, the core components 3A and 3B are components having the same shape and can therefore be produced using a single forming mold, and the cost can be reduced accordingly. Furthermore, the assembly 1 into which the coil 2, the core components 3A and 3B (integrated components obtained by integrating the inner core portions 31 with the respective end surface connecting members 5), and the coil covers 4 are integrated can be easily produced by simply attaching the coil covers 4 to the respective winding portions 2A and 2B and engaging the coil covers 4 with the end surface connecting members 5. In some cases, the assembly 1 can be produced without using an adhesive.

In the reactor 1α of Embodiment 1, the inner core portions 31 are accurately positioned relative to the winding portions 2A and 2B by the coil covers 4, and furthermore, the relative positional relationship between each winding portion 2A, 2B and the corresponding inner core portion 31 is maintained by the coil covers 4. Thus, a step of positioning the inner core portions 31 and the winding portions 2A and 2B in an appropriate arrangement while maintaining the insulation of the inner core portions 31 from the winding portions 2A and 2B can be realized without the necessity for an adhesive, and accordingly the assembly 1 can be easily produced. Moreover, rubbing of each inner core portion 31 against the inner circumferential surface of the corresponding one of the winding portions 2A and 2B due to vibrations transmitted from the vehicle as well as resulting damage to the winding portions 2A and 2B can be suppressed.

The reactor 1α of Embodiment 1 can be installed and used on the installation target while remaining in the assembled state shown in FIG. 1, without the necessity of being accommodated in a case and embedded in a potting resin or the necessity of being entirely molded with a resin. The reason for this is that the various members constituting the reactor 1α are firmly combined together and make a structure that is not able to be disassembled easily. Furthermore, in this reactor 1α, the coil 2 and the like are in a bare state, and thus, when the reactor 1α is used in a state in which it is immersed in, for example, a liquid refrigerant or the like, the reactor 1α can be efficiently cooled. Consequently, the occurrence of a situation in which the operation of the reactor 1α becomes unstable due to heat can be suppressed. It should be noted that the orientation in which the reactor 1α is installed is not limited, and the lower surface (surface on the lower side of the paper plane) of the reactor 1α may be placed on the installation target, or a surface other than the lower surface may be placed on the installation target.

Modification 1-1

The mechanical engagement of the coil covers 4 with the end surface connecting members 5 is not limited to press-fitting of the engagement protrusions 4*p* into the corresponding engagement holes 5*h*. For example, a snap-fit structure may be adopted in which a hook-like retaining portion is provided on the leading end side of each engagement protrusion 4*p*, and the retaining portions are fitted into and hooked on the corresponding engagement holes 5*h*.

Modification 1-2

In Embodiment 1, an example in which the comb teeth 4*c* are formed on the inner circumferential surfaces of the coil covers 4 in advance has been described. In contrast, the coil covers 4 without comb teeth may be fitted to the outer circumferential surfaces of the respective winding portions 2A and 2B. Furthermore, a portion of the coil covers 4 may be melted by heating the coil covers 4 so that the resultant melt enters between the turns of the winding portions 2A and 2B. In that case, at least those portions of the coil covers 4 that oppose the respective winding portions 2A and 2B are formed of a thermoplastic resin. That is to say, this configuration corresponds to a configuration in which the comb teeth 4*c* are formed after the coil covers 4 are attached to the respective winding portions 2A and 2B.

Modification 1-3

Figure 7:
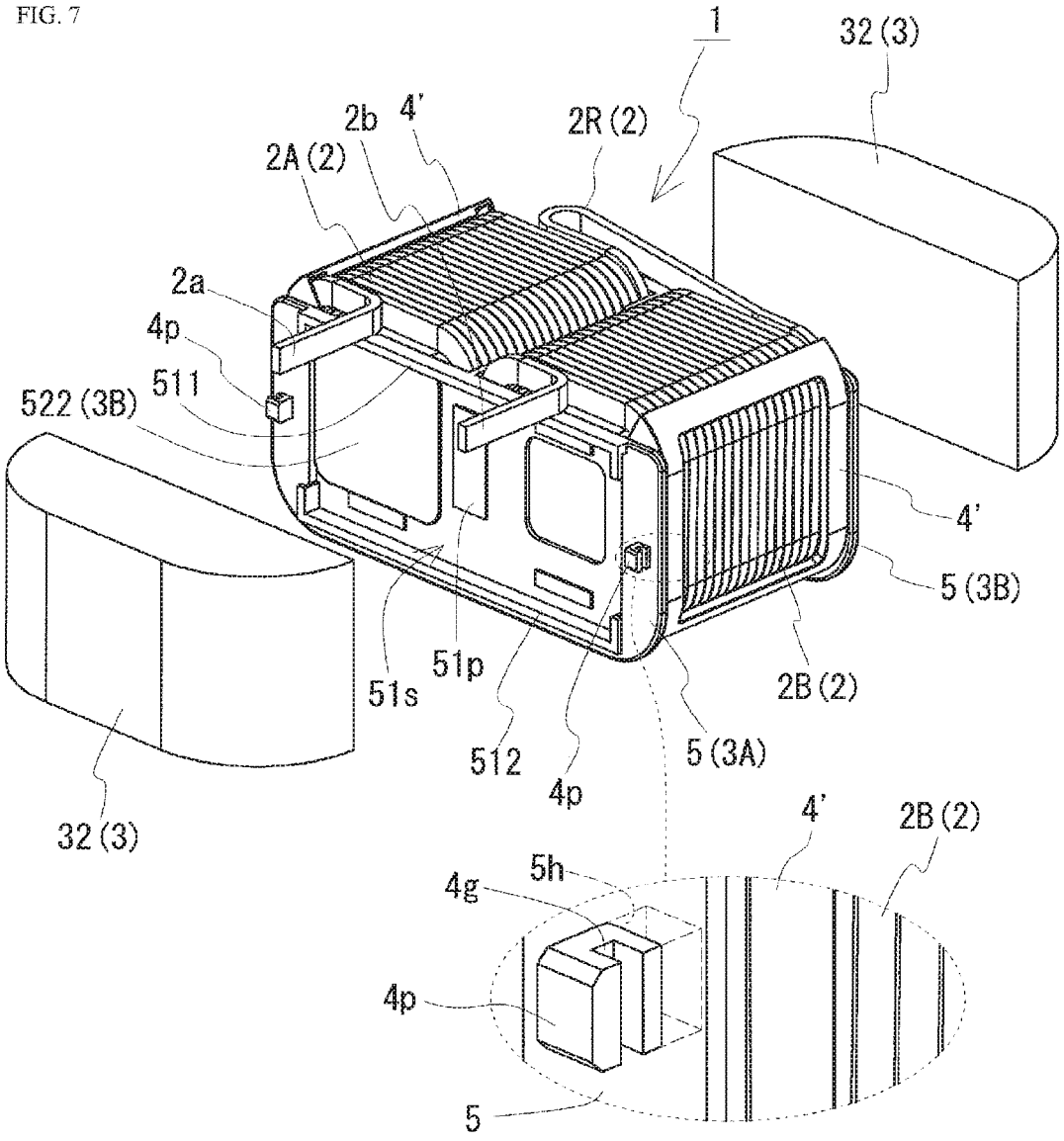
FIG. 7 shows a schematic perspective view for explaining another example of the coil covers.

In this modification, referring to FIG. 7, an example of a configuration in which the engagement protrusions 4*p* of the coil covers 4 described in Embodiment 1 have on their leading end side a detachment preventing shape that suppresses detachment of the outer resin-molded portions will be described. It should be noted that coil covers 4' shown in FIG. 7 are the same as the coil covers 4 of Embodiment 1 that have been described using FIGS. 2, 3, and the like except that the shape of the engagement protrusions 4*p* is different, and therefore the following description will be focused on the differences. Moreover, the constituents (end surface connecting members 5 etc.) other than the coil covers 4' shown in FIG. 7 are substantially the same as those of Embodiment 1. Therefore, like members are denoted by like reference numerals, and their descriptions are omitted.

The engagement protrusions 4*p* of the coil covers 4' have such a length that in a state in which the engagement protrusions 4*p* are inserted into the corresponding engagement holes 5*h* (see also FIG. 3) of the end surface connecting members 5, the leading end side of each engagement protrusion 4*p* protrudes from the surface of the corresponding end surface connecting member 5 that is located on the opposite side to the coil cover 4' side. Thus, the leading end side of each engagement protrusion 4*p* protrudes from the opposite side of the corresponding one end surface connecting member 5. Moreover, when the outer resin-molded portions 6A and 6B (see FIG. 1) that integrate the outer core portions 32 with the respective end surface connecting members 5 are formed, the leading end side of the engagement protrusions 4*p* is embedded in the outer resin-molded portion 6A or 6B. On this leading end side of each engagement protrusion 4*p*, as shown in the inset circled by dotted line in FIG. 7, a detachment preventing shape having a notch 4*g* is formed by cutting away at least a portion of a circumferential surface of the engagement protrusion 4*p*.

In the above-described coil covers 4', the leading end side of each engagement protrusion 4*p* passes through the corresponding engagement hole 5*h* and protrudes from the opposite side of the end surface connecting member 5. This leading end side is embedded in the outer resin-molded portion 6A or 6B (see FIG. 1), and the notch 4*g* (detachment preventing shape) is provided on the leading end side. Since the notches 4*g* are embedded in the outer resin-molded portions 6A and 6B, the outer resin-molded portions 6A and 6B are unlikely to detach, and thus detachment of the outer resin-molded portions 6A and 6B is suppressed. Therefore, the coil covers 4' are securely joined to the outer resin-molded portions 6A and 6B, and detachment of the coil covers 4' from the end surface connecting members 5 can be suppressed via the outer resin-molded portions 6A and 6B. Moreover, the notches 4*g* can also suppress detachment of the outer resin-molded portions 6A and 6B from the respective end surface connecting members 5. Accordingly, the outer core portions 32 and the end surface connecting members 5 are securely integrated, and the outer core portions 32 and the inner core portions 31 are connected more securely.

In this example, the detachment preventing shape on the leading end side of the engagement protrusions 4*p* is the shape having the notch 4*g*; however, the present invention is not limited to this shape, and any shape that suppresses detachment of the outer resin-molded portions 6A and 6B in a state in which it is embedded in the outer resin-molded portions 6A and 6B can be used. For example, a shape having a plurality of notches may also be used, or a shape having a bent portion like the shapes of the detachment preventing portion of the end surface connecting members 5 described above may also be used. In the latter case, it is conceivable to set the internal shape and internal dimensions of the engagement holes 5*h* to be larger than the external shape of the base portions of the engagement protrusions 4*p* so that the leading end side of the engagement protrusions 4*p* can be inserted into the engagement holes 5*h*. In this case, during production of the assembly 1, the positions of the engagement protrusions 4*p* relative to the corresponding engagement holes 51*h* may be unstable. To address this issue, for example, a method may be adopted in which the coil covers 4' are each provided with another separate engagement protrusion, the end surface connecting members 5 are each provided with another separate engagement hole corresponding to this engagement protrusion, and the separate engagement protrusions are engaged with the corresponding separate engagement holes by press-fitting.

Embodiment 2

Converter•Power Conversion Device

The reactor according to the above-described embodiment can be preferably applied to uses where the energization conditions are, for example, maximum current (direct current): about 100 A to 1000 A, average voltage: about 100 V to 1000 V, and working frequency: about 5 kHz to 100 kHz, and typically for a constituent component of an in-vehicle power conversion device installed in an electric automobile, a hybrid automobile, or the like. For these uses, it is expected that a reactor that satisfies the requirements that the inductance when the flowing direct current is 0 A is between 10 μH and 2 mH inclusive, and the inductance when a maximum current flows is 10% or more of the inductance at 0 A can be preferably used. Hereinafter, an example in which the reactor of the above-described embodiment is applied to a power conversion device for use in vehicles will be briefly described with reference to FIGS. 8 and 9.

Figure 8:
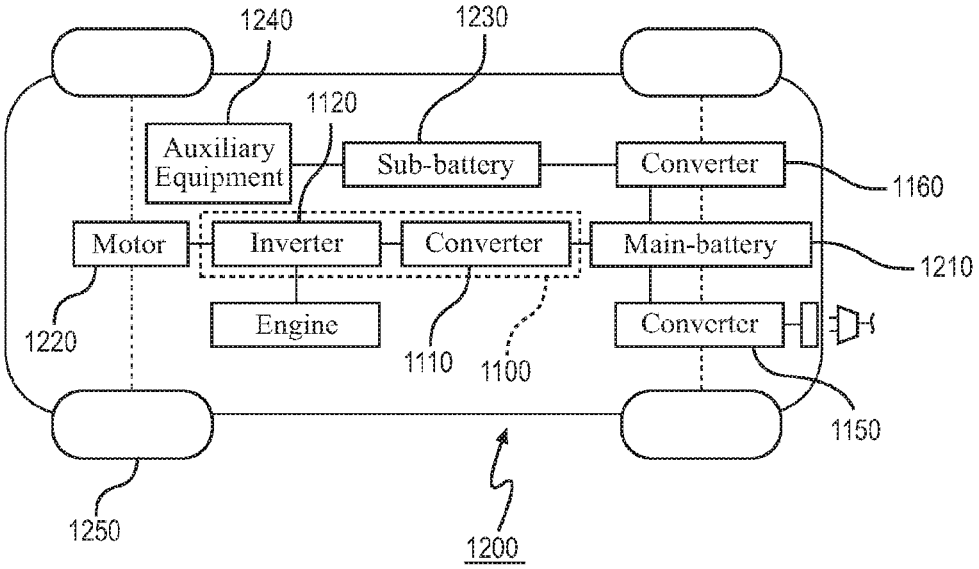
FIG. 8 is a schematic configuration diagram schematically illustrating a power supply system of a hybrid automobile.

For example, a vehicle 1200 such as a hybrid automobile or an electric automobile includes, as shown in FIG. 8, a main battery 1210, a power conversion device 1100 connected to the main battery 1210, and a motor (load) 1220 that is driven by power supplied from the main battery 1210 and that is used for travelling. The motor 1220, which may typically be a three-phase alternating current motor, drives wheels 1250 during travelling, and functions as a generator during regeneration. In the case of a hybrid automobile, the vehicle 1200 includes an engine in addition to the motor 1220. It should be noted that although FIG. 8 shows an inlet as a portion for charging the vehicle 1200, a configuration in which a plug is provided may also be adopted.

The power conversion device 1100 has a converter 1110 that is connected to the main battery 1210 and an inverter 1120 that is connected to the converter 1110 and that converts direct current to alternating current and vice versa. During travelling of the vehicle 1200, the converter 1110 shown in this example increases the direct current voltage (input voltage), about 200 V to 300 V, of the main battery 1210 to about 400 V to 700 V, thereby feeding power to the inverter 1120. Also, during regeneration, the converter 1110 decreases a direct current voltage (input voltage) output from the motor 1220 via the inverter 1120 to a direct current voltage suitable for the main battery 1210, thereby charging the main battery 1210. During travelling of the vehicle 1200, the inverter 1120 converts direct current whose voltage has been increased by the converter 1110 to a predetermined alternating current, thereby feeding power to the motor 1220, while during regeneration, the inverter 1120 converts an alternating current output from the motor 1220 to direct current and outputs the direct current to the converter 1110.

Figure 9:
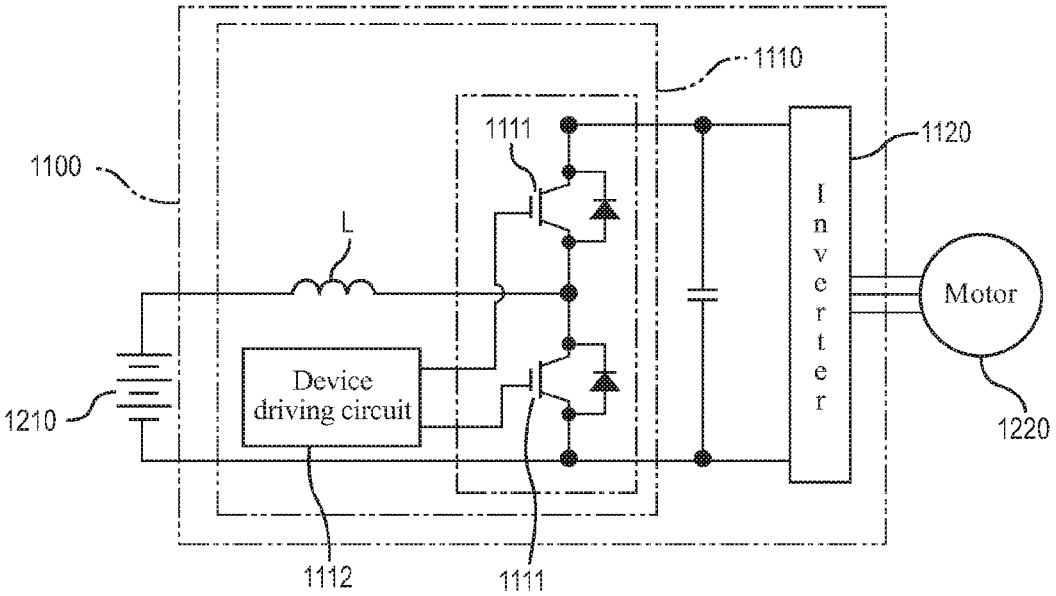
FIG. 9 is a schematic circuit diagram illustrating an example of a power conversion device including a converter.

The converter 1110 includes, as shown in FIG. 9, a plurality of switching elements 1111, a driving circuit 1112 that controls the operation of the switching elements 1111, and a reactor L, and converts an input voltage (here, increases and decreases the voltage) by repeatedly turning ON/OFF (switching operation). A power device such as a field-effect transistor (FET) or an insulated gate bipolar transistor (IGBT) may be used as the switching elements 1111. The reactor L utilizes the property of the coil inhibiting a change in current attempting to flow through the circuit, and has the function of smoothing any change in current when current is about to increase or decrease due to the switching operation. The reactor according to the above-described embodiment is used as this reactor L. The reliability of the power conversion device 1100 (including the converter 1110) can be improved by using the reactor of the above-described embodiment, which has high structural strength and excellent reliability.

Here, the vehicle 1200 includes, in addition to the converter 1110, a converter 1150 for a power feeding device, the converter 1150 being connected to the main battery 1210, and a converter 1160 for an auxiliary equipment power supply, the converter 1160 being connected to a sub-battery 1230, which serves as a power source for auxiliary equipment 1240, and the main battery 1210 and converting a high voltage of the main battery 1210 to a low voltage. The converter 1110 typically performs DC-DC conversion, whereas the converter 1150 for the power feeding device and the converter 1160 for the auxiliary equipment power supply perform AC-DC conversion. There also are converters 1150 for the power feeding device that perform DC-DC conversion. A reactor having the same configuration as the reactor according to the above-described embodiment, with the size, shape, and the like of the reactor being changed as appropriate, can be used as reactors for the converter 1150 for the power feeding device and the converter 1160 for the auxiliary equipment power supply. Moreover, the reactor of the above-described embodiment can also be used for a converter that converts the input power and only increases or only decreases the voltage.

It should be noted that the present invention is not limited to the above-described embodiments, and changes can be made thereto as appropriate without departing from the gist of the present invention. For example, the present invention is also applicable to a reactor including a coil having only a single winding portion.

INDUSTRIAL APPLICABILITY

Reactors according to aspects of the present invention can be used for a constituent component of power conversion devices such as bidirectional DC-DC converters installed in electric vehicles such as hybrid automobiles, electric automobiles, and fuel-cell electric automobiles.

The invention claimed is:

1. A reactor comprising:

a coil having a winding portion;

a magnetic core having an inner core portion disposed inside the winding portion and an outer core portion disposed outside the winding portion;

an end surface connecting member that is fixed to an end portion of the inner core portion and disposed between an end surface of the winding portion and the outer core portion;

an outer resin-molded portion that integrates the outer core portion and the end surface connecting member; and a coil cover that is attached to an outer circumferential surface of the winding portion, wherein a detachment preventing portion is formed in the end surface connecting member, the detachment preventing portion being embedded in the outer resin-molded portion and having a detachment preventing shape that suppresses detachment of the outer resin-molded portion, an engagement protrusion for engaging with the end surface connecting member is formed in the coil cover, and an engagement hole into which the engagement protrusion is fitted is formed in the end surface connecting member.

2. The reactor according to claim 1, wherein the winding portion has a quadrangular tube shape, and an end surface shape of the coil cover is an L-shape, and the coil cover has a bent portion corresponding to a corner portion of the winding portion and two picture frame-shaped frame portions connected to each other via the bent portion.

3. The reactor according to claim 1, wherein the coil has a pair of said winding portions that are arranged side-by-side, the magnetic core is a ring-shaped core having a pair of said inner core portions that are disposed inside the respective winding portions and a pair of said outer core portions that are connected to opposite ends of the inner core portions, a plurality of said end surface connecting members are provided, each being disposed between a respective end surface of the pair of winding portions and one of the outer core portions, and a pair of core components are provided in each of which one of the end surface connecting members is integrally molded with the end portion of a corresponding one of the inner core portions by resin molding.

4. The reactor according to claim 3, wherein the engagement protrusion is inserted into the engagement hole from the coil cover side, a leading end side of the engagement protrusion protrudes from an opposite side of the end surface connecting member and is embedded in the outer resin-molded portion, and the engagement protrusion has a detachment preventing shape on the leading end side, the detachment preventing shape suppressing detachment of the outer resin-molded portion.

5. The reactor according to claim 3, wherein the winding portion has a quadrangular tube shape, and an end surface shape of the coil cover is an L-shape, and the coil cover has a bent portion corresponding to a corner portion of the winding portion and two picture frame-shaped frame portions connected to each other via the bent portion.

6. The reactor according to claim 1, wherein the engagement protrusion is inserted into the engagement hole from the coil cover side, a leading end side of the engagement protrusion protrudes from an opposite side of the end surface connecting member and is embedded in the outer resin-molded portion, and the engagement protrusion has a detachment preventing shape on the leading end side, the detachment preventing shape suppressing detachment of the outer resin-molded portion.

7. The reactor according to claim 6, wherein the winding portion has a quadrangular tube shape, and an end surface shape of the coil cover is an L-shape, and the coil cover has a bent portion corresponding to a corner portion of the winding portion and two picture frame-shaped frame portions connected to each other via the bent portion.

8. The reactor according to claim 1, wherein the detachment preventing shape of the detachment preventing portion is a shape having a bent portion.

9. The reactor according to claim 8, wherein the coil has a pair of said winding portions that are arranged side-by-side, the magnetic core is a ring-shaped core having a pair of said inner core portions that are disposed inside the respective winding portions and a pair of said outer core portions that are connected to opposite ends of the inner core portions, a plurality of said end surface connecting members are provided, each being disposed between a respective end surface of the pair of winding portions and one of the outer core portions, and a pair of core components are provided in each of which one of the end surface connecting members is integrally molded with the end portion of a corresponding one of the inner core portions by resin molding.

10. The reactor according to claim 8, wherein the engagement protrusion is inserted into the engagement hole from the coil cover side, a leading end side of the engagement protrusion protrudes from an opposite side of the end surface connecting member and is embedded in the outer resin-molded portion, and the engagement protrusion has a detachment preventing shape on the leading end side, the detachment preventing shape suppressing detachment of the outer resin-molded portion.

11. The reactor according to claim 8, wherein the winding portion has a quadrangular tube shape, and an end surface shape of the coil cover is an L-shape, and the coil cover has a bent portion corresponding to a corner portion of the winding portion and two picture frame-shaped frame portions connected to each other via the bent portion.

* * * * *